United States Patent [19]

Winckler

[11] Patent Number: 4,516,637

[45] Date of Patent: May 14, 1985

[54] HOISTING APPARATUS AND METHOD FOR RAISING OIL TUBING

[75] Inventor: Elmer Winckler, Anchorage, Ak.

[73] Assignees: James W. McManus, Bakersville, N.C.; James Backus, Cheyenne, Wyo.

[21] Appl. No.: 521,618

[22] Filed: Aug. 8, 1983

[51] Int. Cl.[3] ..... E21B 19/00

[52] U.S. Cl. ..... 166/377; 166/85; 212/231; 254/281

[58] Field of Search ..... 166/377, 85, 75 R, 77.5, 166/79, 77; 212/231; 254/386, 281

[56] References Cited

U.S. PATENT DOCUMENTS

| | | | |
|---|---|---|---|
| 1,165,483 | 12/1915 | Zied . | |
| 1,198,656 | 9/1916 | Pick | 254/281 |
| 1,729,940 | 10/1929 | Hinderliter | 166/85 X |
| 2,772,010 | 11/1956 | Buehring | 214/394 |
| 2,999,600 | 9/1961 | Gates . | |
| 4,111,316 | 9/1978 | Wappler | 214/754 |
| 4,422,508 | 12/1983 | Rutledge, Jr. | 166/376 |

FOREIGN PATENT DOCUMENTS

| | | | |
|---|---|---|---|
| 974040 | 9/1975 | Canada | 212/231 |

*Primary Examiner*—Stephen J. Novosad
*Assistant Examiner*—Mark J. DelSignore
*Attorney, Agent, or Firm*—Price, Heneveld, Huizenga & Cooper

[57] ABSTRACT

A hoisting apparatus mounted on a vehicle and used to raise oil tubing from within an oil well casing or the like having a lower telescoping boom element that includes a lower secured member and a lower extending member oriented to extend in one direction, and an upper telescoping boom element that includes an upper secured member mounted on the lower extending member with an upper extending member oriented to extend in a direction parallel to but opposite from the one direction. A pulley allows a lifting cable to depend from the lifting end and a lifting cable extends from the extended free end of the upper extending member to the first pulley so that the lower extending member can be extended to position the lifting cable and the upper extending member can be extended to raise the lifting cable. Preferably, another pulley changes the direction of travel of the lifting cable at the extended free end of the upper extending member, a pair of support legs are secured to the upper telescoping boom to support the boom while lifting the oil tubing and a clamp is connected to the upper telescoping boom to clamp onto and support the lifted object independent of the lifting cable. A working cable supply drum preferably feeds working cable over the end of the upper telescoping boom and down into the oil well casing.

23 Claims, 10 Drawing Figures

HOISTING APPARATUS AND METHOD FOR RAISING OIL TUBING

BACKGROUND OF THE INVENTION

The present invention relates to hoisting apparatus and in particular to a vehicle having a hoisting apparatus mounted thereon which is preferably used in the lifting of oil well tubing.

Hoisting devices and vehicles having movable derricks or booms of various designs have long been used to lift objects. Although many such hoisting device designs utilize a telescoping boom, this telescoping action is normally only utilized to extend and position the boom and not to perform other functions. In oil well operations a winch or rotating drum assembly is used to raise or lower the lifting cable that is placed out over this telescoping boom. In such hoisting devices, some type of mechanical rotary drive must be used to power the winch. Since these telescoping booms usually use a hydraulic cylinder and piston to extend the boom, a separate hydraulic pump system must be provided in addition to the rotary drive.

Heretofore, vehicles having hoisting apparatus have been used in the lifting of oil well tubing during the repair or other maintenance of the oil well. Due to the great weight of the oil tubing being lifted and the other needs of the vehicle, such vehicles normally carry a large upright derrick or mast-like assembly. This derrick assembly is erected over the oil well to provide a support for the lifting cable. Normally, these vehicles use a rotary winch with this derrick to take up the lifting cable when lifting the tube. Each vehicles are very large since they are specifically designed to be used in the complete removal of oil tubing. To permit this complete removal, the derrick assembly must be sufficiently tall that an entire section of oil tube can be removed from the oil casing while supported from the derrick. These vehicles are very difficult to maneuver due to the large derrick assembly and are both expensive and difficult to transport, assemble and store.

SUMMARY OF THE INVENTION

The present invention relates to a hoisting method and apparatus which can be mounted on a vehicle and easily positioned for exerting an upward pull on objects beneath it, such as a string of oil pipes or tubing, without the requirement of expensive and cumbersome equipment.

In accordance with this invention, there is provided the combination of two boom assemblies, one mounted in piggyback fashion on the other. The lower boom assembly includes a secured stationary section arranged to extend angularly upward and an extending section which when extended extends in the same inclined direction away from the stationary section. The upper boom assembly is mounted as previously stated in piggyback fashion on the extending section of the lower boom assembly. On the upper end of the upper boom assembly is mounted a pulley means over which a cable is mounted for exerting an upward pulling force on objects beneath. The cable is actuated by a piston and rod assembly extending from the lower end of the upper boom assembly and adapted for movement in a direction opposite to the end of the upper boom assembly on which the pulley means is mounted. Thus, an object is pulled upwardly by first extending the lower boom assembly to position the cable and pulley and then the cable is actuated by extending the piston and rod assembly in the opposite direction.

The above apparatus is especially provided for removing oil well tubing from an oil well casing. In such method, any apparatus blocking the oil well tubing is first removed and the lower extending member is extended until the lifting cable is positioned above the tubing. The lifting cable is secured to the tubing and the piston and rod assembly of upper boom is extended to raise the lifting cable and tubing. The tubing is then clamped to support the tubing independent of the lifting cable.

The hoisting apparatus is especially designed and is preferably mounted on a motor vehicle. Support legs are also preferably secured to the lifting end and a working cable supply drum feeds working cable over additional pulleys located at the lifting end in order to feed the working cable down into the oil casing. Secured to the lifting end is a bowl-shaped clamping element that is shaped to receive a set of tapered clamping inserts. The inserts are used to clamp onto and support the oil well tubing independent of the lifting cable.

The present hoisting apparatus and method provides a relatively compact device that can replace much larger vehicles in some operations. When mounted on a vehicle, the assembly is much smaller and easier to maneuver than previous large oil well maintenance vehicles.

The present hoisting apparatus utilizes two parallel telescoping booms which telescope in opposite directions. Since one of these booms is used to extend the boom and the other is used to raise the lifting cable, a single hydraulic pump drive can be used for both extending the boom and lifting. A separate rotary winch of sufficient size to lift the oil well tubing is therefor not required. The hoisting apparatus is well suited to lifting oil well tubing when it is not necessary to remove an entire section of oil tubing from the oil well casing. Since the apparatus has a separate working cable supply, other apparatus such as temperature sensors may be placed down inside of the oil well casing while the tubing is in a raised position.

These and many other advantages and uses will be apparent to those skilled in the art from the following description and drawings.

DETAILED DESCRIPTION OF THE PREFERRED EMBODIMENT

Figure 1:
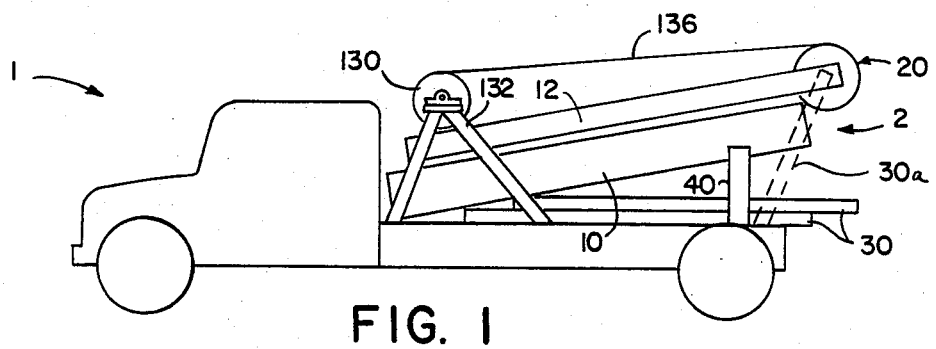
FIG. 1 is a side elevational view of a motor vehicle and hoisting apparatus embodying the present invention.
Figure 2:
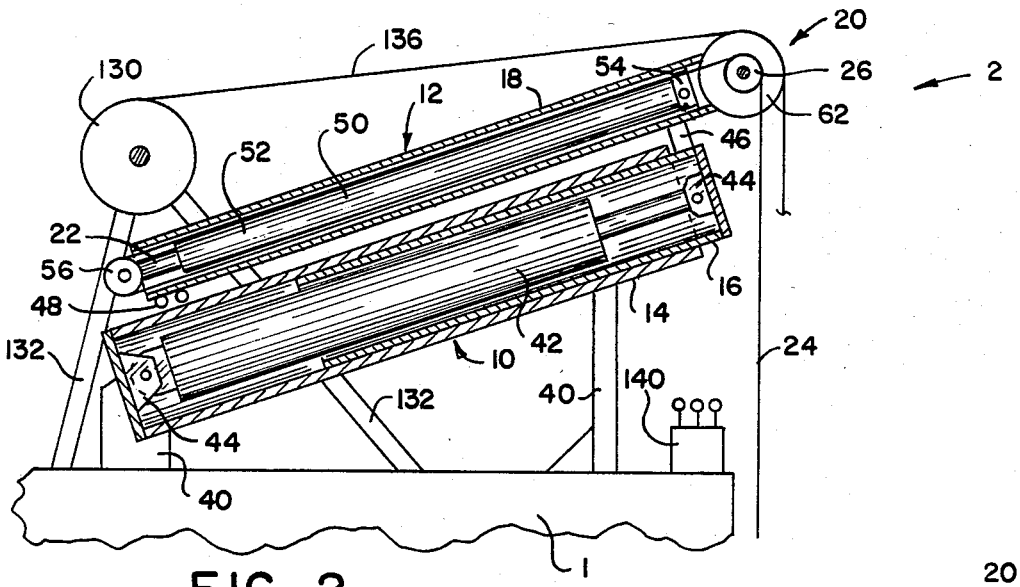
FIG. 2 is a fragmentary, sectional view of the hoisting apparatus assembly of FIG. 1, shown in a storage position.

In the preferred embodiment shown in FIG. 1, a motor vehicle 1 has a hoisting assembly 2 mounted on its rear carrying area. Vehicle 1 with hoisting assembly 2 is preferrably used to raise up oil well tubing 4 and the like from within an oil well casing 6, as shown generally in FIGS. 2 and 3. Hoisting assembly 2 has a lower telescoping boom 10 and an upper telescoping boom 12 mounted in piggyback fashion on boom 10. As shown in FIG. 2, lower boom 10 has a lower secured stationary section 14 and an extending section 16 supporting the upper boom 12. Lower boom 10 telescopes in order to extend boom 12 and position a lifting end 20 over the object to be lifted.

Upper boom 12 has a piston and rod assembly 22 which is adapted to extend parallel to but in a direction opposite to that of lower exending member 16. Assembly 22 may therefor extend to raise a lifting cable 24, FIGS. 2 and 3, that runs from upper extending member 22 to a first pulley 26 at lifting end 20 and then down to oil tube 4.

Figure 3:
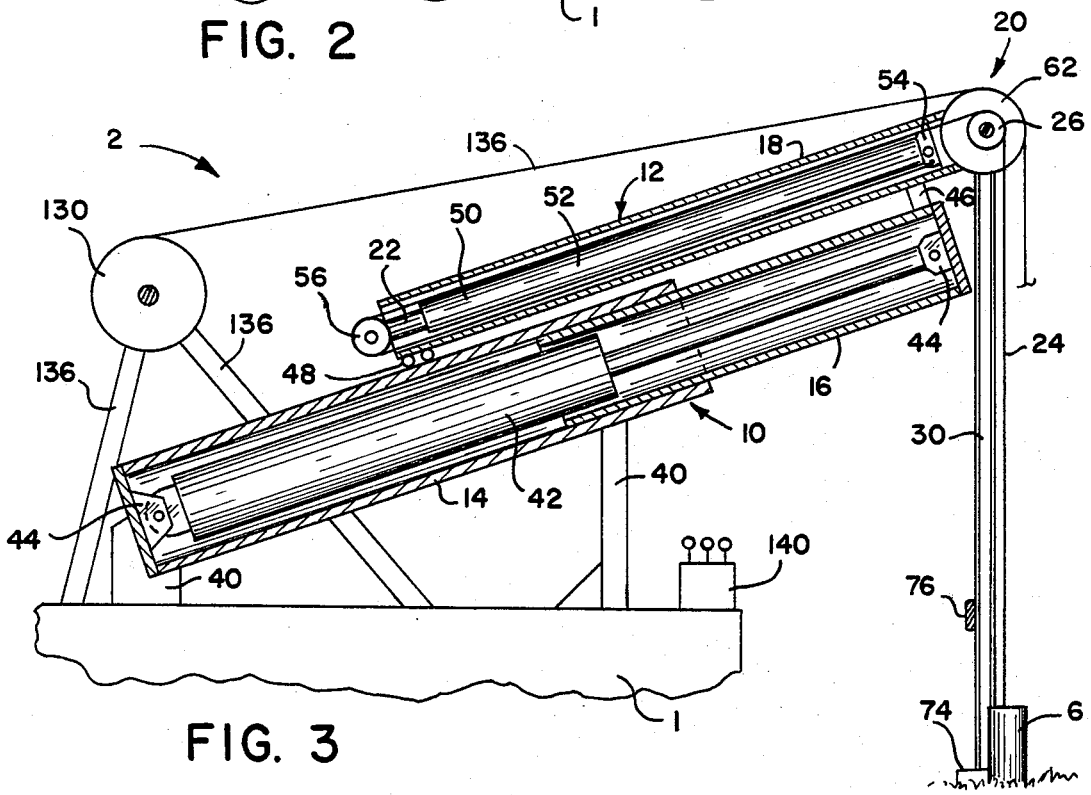
FIG. 3 is a fragmentary, side elevational, sectional view of the hoisting apparatus of FIG. 2 with the telescoping boom extended and positioned over an oil well casing.
Figure 4:
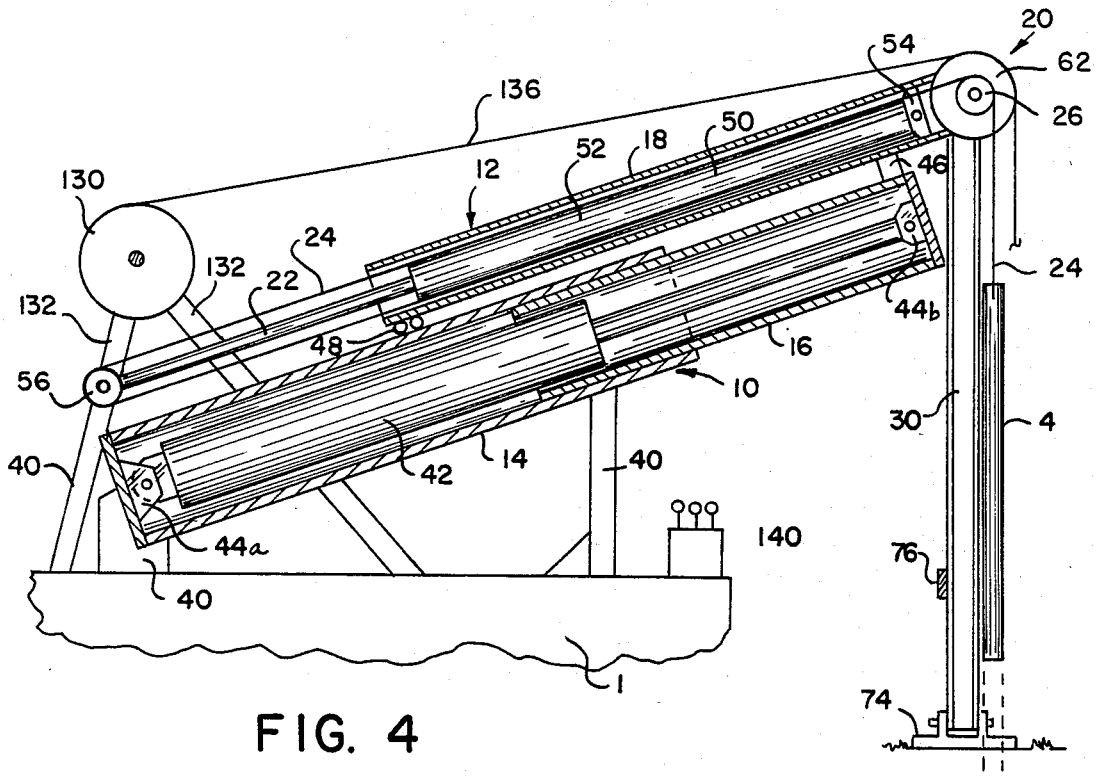
FIG. 4 is a fragmentary, side elevational, sectional view of the hoisting apparatus assembly of FIG. 2, shown with the boom extended and the lifting cable actuated to lift an oil tube.
Figure 8:
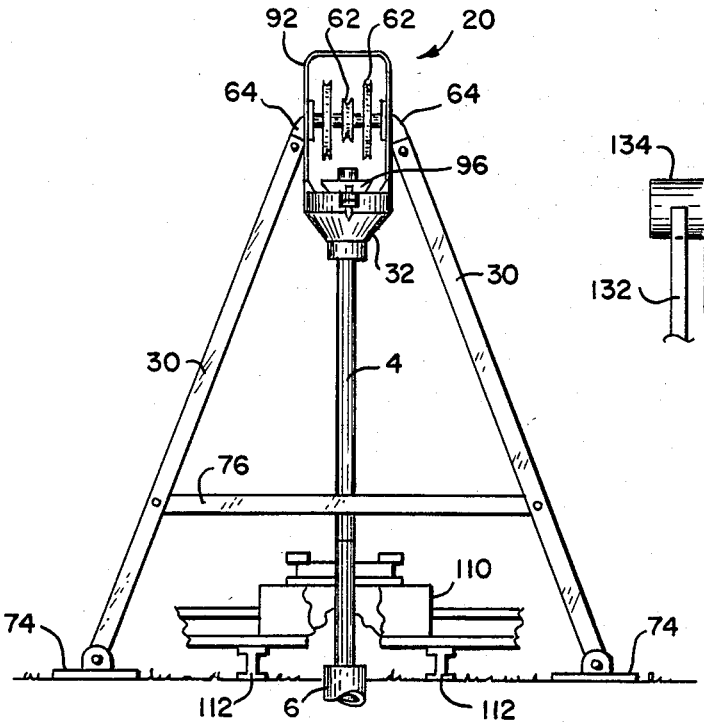
FIG. 8 is a fragmentary, rear elevational view of the lifting end of the extended boom of FIG. 4, shown with support legs secured thereto and an oil tube lifted and secured in the clamping device.
Figure 7:
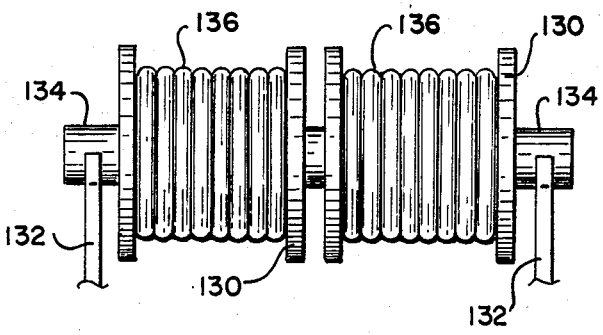
FIG. 7 is a fragmentary, rear elevational view of a working cable supply drum.

Preferably, a set of support legs 30 brace lifting end 20, as shown in FIGS. 3, 4 and 8. A clamping device 32, FIGS. 5, 6, 8 and 9, is secured to lifting end 20 and is used to clamp oil tube 4 so that tube 4 is supported independent of lifting cable 24.

As shown in FIGS. 2–4, the stationary section 14 of lower boom 10 is a rigid, elongated casing that is mounted on vehicle 1 in an inclined position by a set of struts 40. Casing 14 telescopingly receives extending section 16 which is also a rigid, elongated casing. This is accomplished by a hydraulic piston and cylinder unit 42 mounted within casings 14 and 16 and secured to mounting blocks 44*a* and 44*b* in the lower end of casing 14 and in the upper end of casing 16, respectively, so that when hydraulic unit 42 is activated it either telescopingly extends or retracts lower extending member 16. Struts 40 hold telescoping boom 10 at an upward angle, so that lower extending member 16 extends to the rear and at an upward angle to vehicle 1.

Member 18 is a rigid, elongated casing that is firmly connected to lower extending member 16 by a connector 46 or any other conventional means. Members 18 and 16 are spaced sufficiently so that member 18 can slide past the casing or section 14. Thus, upper secured member 18 is shifted along with lower extending member 16 when hydraulic unit 42 is activated. Opposite lifting end 20 is a set of rollers 48 that are mounted between upper and lower secured members 14 and 18. Rollers 48 allow upper secured member to easily slide along the upper surface of lower secured member 14 while lower secured member 14 partially supports the weight of upper secured member 18. Alternatively, rollers 48 could be replaced by a guide or other follower that is received in a track on the upper surface of upper secured member 18. With such a track guide upper secured member 18 would also be prevented from pivoting upward when larger weights are suspended from lifting end 20.

Mounted within the boom member 18 is a hydraulic unit 50, FIGS. 2–4 which includes cylinder 52 connected to member 18 at lifting end 20 by a mounting block 54. Hydraulic unit 50 is of conventional design and has a piston (not shown) and rod 22 that extends from cylinder 52. Mounted on the free extending end of piston rod 22 is a freely rotating pulley 56 around which lifting cable 24 rides. Lifting cable 24 is a wire cable of sufficient thickness to support a string of oil tubing or other object to be lifted. It is attached to mounting block 54, runs around pulley 56 back to pulley 26 and then hangs downward as shown in FIGS. 2–4. Cable 24 has on its free end a connector of any conventional design that is adapted to connect to the object to be lifted. For example, the connector can be a hook or clamping device used in oil well drilling. Since lower telescoping boom 10 angles upward, upper telescoping boom 12 is oriented at a downward angle so that hydraulic unit 50 either extends pulley 56 away from lifting end 20 or retracts pulley 56 toward lifting end 20 when activated. This movement of pulley 56 causes the free end of lifting cable 24 to raise or lower as described more fully below.

Figure 6:
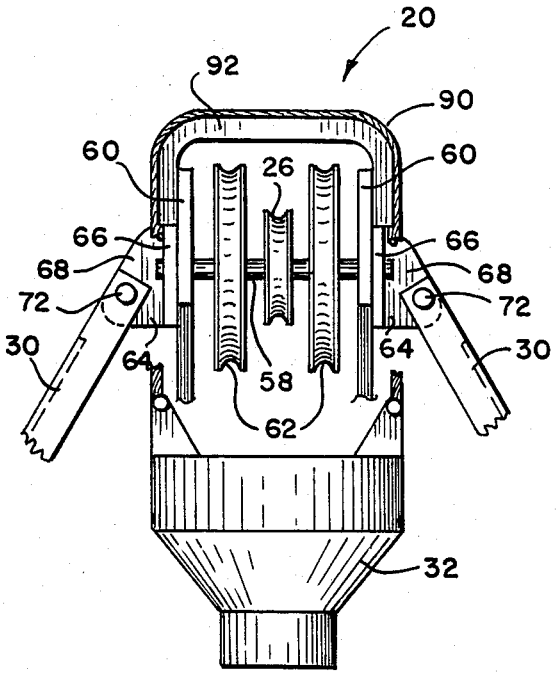
FIG. 6 is a fragmentary, rear elevational view of the lifting end of the extended boom shown in FIG. 5.

As shown in FIG. 6, pulley 26 is rotatably mounted on a shaft 58 that extends between two flanges 60 forming a clevis at lifting end 20 on upper secured member 18. Rotatably mounted on shaft 58 to either side of pulley 26 is a larger diameter pulley 62. Pulleys 26 and 62 are all freely rotating so that each pulley rotates independently of the others. Pulleys 62 are used to run other cables into casing 6 as described more fully below.

Figure 5:
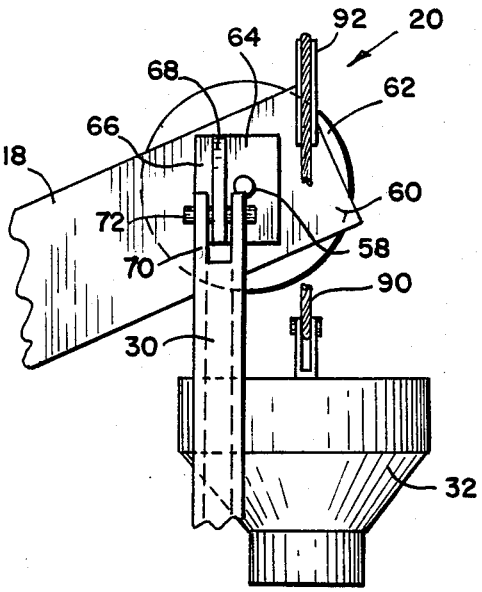
FIG. 5 is a fragmentary, side elevational view of the lifting end of the extended boom of FIG. 3, shown with support legs and an oil tube clamping device attached thereto.

Support legs 30 are removably secured to lifting end 20 by a pair of attachment brackets 64, FIGS. 5 and 6. Each attachment bracket 64 has a flat base plate 66 that is mounted on shaft 58 so as to rotate relative to lifting end 20. Extending outward from base plate 66 is a mounting flange 68. Each leg 30 ends in a clevis 70 which can fit over and be pinned to mounting flange 68 by a pin 72. Pin 72 is removable so that legs 30 can be disconnected from lifting end 20 and stored for transportation. When legs 30 are connected to lifting end 20, brackets 64 allow legs 30 to be pivoted in order to adapt to the particular terrain at the oil well site. As shown in FIGS. 4 and 8, legs 30 each have base pads 74 that are also pivotally connected to legs 30 in order to adapt to the particular terrain. Legs 30 are connected by a cross brace 76 that prevents legs 30 from separating when hoist 2 is being used. When assembled, legs 30 have an overall "A" configuration, FIG. 8, and form a steady tripod with upper and lower telescoping booms 10, 12.

Figure 9:
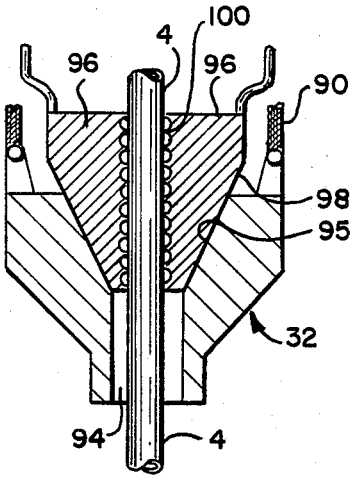
FIG. 9 is a fragmentary, sectional view of the clamping device of FIG. 8 shown secured to a raised section of oil tube.

Clamping device 32 is a funnel or bowl-shaped element that is secured to lifting end 20 by a cable 90, FIGS. 5 and 6. Flanges 60 have a curved bracket 92, FIGS. 5 and 6, that arches up over pulleys 26 and 62. Cable 90 rests in a groove in bracket 92 so that clamping device 32 can be shifted slightly in order to align it with casing 6. As shown in FIG. 9, clamping device 32 has an aperture 94 therethrough, at least the upper portion of which is frusto-conical in shape with sides 95 that converge downward to provide the clamping action described below. As shown in FIG. 9, a set of slips of any design conventionally known and used in the oil drilling field fit into aperture 94. Slips 96 have an angled surface 98 and a vertical surface 100 that is ribbed or has some other raised configuration to provide a gripping surface. Slips 96 are arcuately shaped so that when they are inserted into aperture 94 and contact angled surfaces 95, slips 96 will converge and ribbed vertical surfaces 100 will clamp onto an oil tube 4 that extends through aperture 94. When a set of slips have been inserted in clamping device 32 and clamped onto oil tube 4, oil tube 4 will be completely supported by lifting end 20 without requiring support from lifting cable 24.

While hoisting device 2 is being used it may be necessary to support oil tube 4 from a location just above casing 6, such as when an object must be slipped over the end of tubing 4 and so the tube end is required to be free. As shown in FIG. 8, a rotary table 110 of conventional design is positioned just above casing 6 on beams 112 or the like. A set of slips 96 can then be inserted into rotary table 110 in order to clamp onto oil tube 4 in the manner described above but at a location that leaves the end of tube 4 free.

Figure 10:
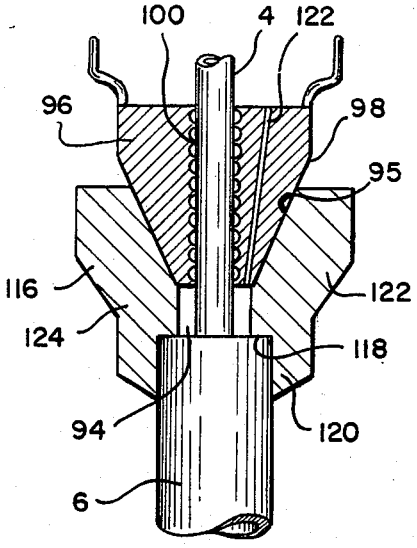
FIG. 10 is a sectional elevational view of an independent clamping device connected to an oil well casing, shown secured to a raised section of oil tube.

Alternatively, a clamping device 116 can be mounted on casings 6, as shown in FIG. 10. Clamping device 116 is shaped generally the same as clamping device 32, with the exception that it has a bottom portion that is adapted to mounting on casing 6. Clamping device 116 has an annular mounting surface 118 located beneath angled sides 95 that has a diameter to mate with the top of casing 6. Depending from mounting surface 118 is an annular positioning flange 120 that extends around mounting surface 118. Positioning flange 120 has an inside diameter slightly greater than the outside diameter of casing 6 and forms a collar or coupling that depends down around casing 6 when clamping device 116 is positioned thereon, FIG. 10. So positioned clamping device 116 is solely supported directly on casing 6 rather than resting on the ground, while positioning flange 120 prevents device 116 from sliding off casing 6. Alternatively, annular mounting surface 118 may extend around positioning flange 120 so that positioning flange 120 slides down inside of casing 6 when clamping device 116 is rested on casing 6 (not shown). Clamping device 116 also may be split into two separable halves or sides that are locked together by a pair of pins that pass through overlapping flanges extending from the halves. This allows device 116 to be pinned around tube 4 even if the top of tube 4 is hanging from hoisting assembly 2 or otherwise obstructed.

As shown in FIG. 10, slips 96 are identical to those described above for use with clamping device 32, with the exception that an aperture 122 extends from the top through to the bottom of one slip 96. Aperture 122 allows a cable or other instrument to be inserted through slips 96 and fed down into casing 6 while tube 4 is being supported on casing 6. The slip 96 that has aperture 122 therethrough may also be used with rotary table 110 as described above.

As shown in FIGS. 2–4, 7, a pair of working cable supply drums 130 are supported on a set of struts 132 that are connected to vehicle 1. Drums 130 are rotated by a pair of rotary drive motors 134, FIG. 7, as is conventionally known in the art. Carried on each drum 130 is a supply of electrical working cable 136. Working cable 136 feeds off of supply drum 130, extends over large diameter pulleys 62 and depends down toward oil well casing 6, FIGS. 2–4. Working cable 136 is used to insert electrical devices into casing 6 and therefore has a diameter sufficient to pass through aperture 122 in slips 96 when clamping element 116 is seated on casing 6.

As shown in FIGS. 2–4, a control unit 140 is positioned on the rear of truck 1 so that an operator can stand at the rear of the truck and control hydraulic units 42 and 50, also supply drum 130. Control unit 140 can be of any conventional design as is well known in the art for control of hydraulic and electrical devices.

METHOD OF OPERATION

To lift an oil tube 4 from within a casing 6, or to lift other like objects, vehicle 1 with attached hoisting assembly 2 is positioned at the lifting site. Hydraulic unit 42 is activated so that lower extending boom member 16 telescopes outward carrying with it boom 12. Hydraulic unit 42 is activated until lifting end 20 is positioned directly over casing 6, as shown in FIG. 3.

Support legs 30 are pinned to attachment brackets 64 by pins 72 and pivoted until base plates 74 solidly contact the ground surface. Cross brace 76 is secured between legs 30 (FIG. 8) so that lifting end 20 is firmly supported. Support cable 90 on clamping device 32 is looped over bracket 92 so that clamping device 32 is supported on lifting end 20 as shown in FIGS. 5 and 6. Lifting cable 24 is passed through aperture 94 in clamping device 32 and is connected to the top of oil tubing 4 by any conventional means. Hydraulic unit 50 is then activated to extend piston rod 22 along with mounted pulley 56 from the position shown in FIG. 3 to the position of FIG. 4. Since lifting cable 24 which is secured to mounting block 54 extends along the cylinder of unit 50, reverses direction around pulley 56 and then passes over pulley 26, the portion of lifting cable 24 attached to the tubing 4 is raised as piston rod 22 is extended.

Once tubing 4 has been raised to the desired height, a set of slips 96 are slid down into aperture 94 in clamping device 32, FIGS. 8 and 9. Slips 96 firmly clamp onto tubing 4 in order to support tubing 4 independent of lifting cable 24. Lifting cable 24 can then be disconnected if so desired.

If electrical devices are to be placed down inside of casing 6, electrical working cable supply drum 130 is activated to feed working cable 136 off of drum 130, around pulleys 62 and then down into casing 6.

If it is necessary to pass some apparatus over the top end of tubing 4, a rotary table 110 is assembled over casing 6. Alternatively, clamping device 116 can be seated on the top of casing 6 to be directly supported thereon. After tubing 4 has been raised to the desired height, a set of slips 96 are slid down into either rotary table 110 or clamping device 116 to clamp and support tube 4 independently of lifting cable 24. As supply drum 130 is activated working cable 136 is fed down through aperture 122 in slips 96 in order to run down into casing 6.

After maintenance on the oil well is finished, upper hydraulic unit 50 is again activated in order to retract piston rod 22 and pulley 56. Cable 24 can then be disconnected from oil tube 4 and support legs 30 disconnected from attachment brackets 64. Legs 30 are slid onto the bed of truck 1, FIG. 1, to be stored underneath hoisting assembly 2. Hydraulic unit 42 is again activated to retract lower section 16 and cause member 18 to pass over stationary section 14. Lifting cable 24 can be coiled or otherwise stored for transportation. Alternatively, if a set of telescoping legs 30*a*, FIG. 1, are used, legs 30*a* are pivoted upward and the leg bases secured to the truck bed for transportation.

It will be understood by one skilled in the art that various other clamping or secondary support devices can be used with hoisting assembly 2 in order to secure tubing 4 independent of lifting cable 24 after it has been raised. Also, it will be recognized that although well suited to the above method of lifting oil tubing, the above described hoisting assembly 2 can be used to lift a variety of objects and is not necessarily confined to use in hoisting oil well tubing. Further, it is not necessary that hoisting assembly 2 be mounted on the bed of a truck to be independently movable.

It is to be understood by those skilled in the art that the above is just a description of the preferred embodiment and that various improvements or modifications can be made without departing from the spirit of the invention described therein. The scope of the protection afforded the invention is to be determined by the claims which follow and the breadth of intepretation which the law allows.

The embodiments of the invention in which an exclusive property or privilege is claimed are defined as follows:

1. A hoisting apparatus, comprising:

a support frame;

a first telescoping boom assembly mounted on said support frame, including a first secured member and a first extending member oriented to extend in a first direction;

a second telescoping boom assembly mounted on said first boom assembly and secured to said first extending member, for movement therewith, said second telescoping boom assembly having a lifting upper end and a lower end from which a second extending member is adapted to extend in a direction parallel to but opposite from said first direction;

support legs secured to said lifting upper end and positionable to contact the ground surface;

pulley means having cable receiving means for receiving a lifting cable for allowing a lifting cable to ride thereon and movably depend from said lifting upper end; and a lifting cable extending from the extended free end of said second extending member over said pulley means and depending therefrom, whereby said first extending member can be extended to position said lifting cable over the object to be lifted and said second extending member can be extended to pull on said lifting cable and raise the depending portion thereof.

2. An apparatus as defined in claim 1, wherein said pulley means is a first pulley means and said second telescoping boom assembly includes a second pulley means mounted for movement with said second boom assembly and having cable receiving means for receiving said lifting cable for allowing said lifting cable to ride thereon and for changing the direction of travel of said lifting cable at the extended free end of said second extending member, said lifting cable extending from a secured portion of said second telescoping boom assembly around said second pulley means and to said first pulley means, whereby the position of said second pulley means relative to said first pulley means is independent of the extension of said first telescoping boom assembly.

3. The apparatus as defined in claim 2, further comprising a working cable supply drum with a working cable thereon rotatably mounted on said support frame;

a third pulley means having cable receiving means for receiving said working cable and for allowing said working cable to extend from said supply drum and to ride thereon and movably depend from said lifting upper end, said third pulley means and said first pulley means being mounted coaxially on said second telescoping boom assembly lifting upper end.

4. The apparatus as defined in claim 3, wherein said third pulley means includes a first working pulley and a second working pulley coaxially mounted on a shaft.

5. The apparatus as defined in claim 4, further comprising clamping means for clamping onto and securing the hoisted object to said lifting upper end other than by said lifting cable and for allowing said lifting cable to be disconnected from the hoisted object, said clamping means depending from said lifting upper end and positioned beneath said first pulley means.

6. The apparatus as defined in claim 5, wherein said clamping means includes a bowl element secured to said lifting upper end and a set of clamping inserts, said bowl element having an aperture extending vertically therethrough, at least the upper portion of said aperture being generally frusto-conical in configuration so as to have angled sides, said clamping inserts each having an overall arcuate configuration with a generally downwardly tapered thickness corresponding to said angled sides, whereby the lifted object may pass through said aperture and said inserts slid down into said aperture until said angled sides cause said tapered inserts to converge and securely clamp onto the lifted object.

7. The apparatus as defined in claim 6, wherein said support frame is mounted on a motor vehicle.

8. The apparatus as defined in claim 1, further comprising a working cable supply drum with a working cable thereon rotatably mounted on said support frame;

working pulley means having means for receiving said working cable and for allowing said working cable to extend from said supply drum and to ride thereon and movably depend from said lifting end, said working pulley means and said first pulley means being mounted coaxially on said second telescoping boom assembly lifting upper end.

9. The apparatus as defined in claim 8, wherein said working pulley means includes a first working pulley and a second working pulley coaxially mounted on a shaft.

10. The apparatus as defined in claim 1, further comprising clamping means for clamping onto and securing the hoisted object to said lifting upper end other than by said lifting cable in order to allow said lifting cable to be disconnected from the hoisted object, said clamping means depending from said lifting upper end and positioned beneath said first pulley means.

11. The apparatus as defined in claim 10, wherein said clamping means includes a bowl element secured to said lifting upper end and a set of clamping inserts, said bowl element having an aperture extending vertically therethrough, at least the upper portion of said aperture being generally frusto-conical in configuration so as to have angled sides, said clamping inserts each having an overall arcuate configuration with a generally downwardly tapered thickness corresponding to said angled sides, whereby the lifted object may pass through said aperture and said inserts slid down into said aperture until said angled sides cause said tapered inserts to converge and securely clamp onto the lifted object.

12. A vehicle for raising an oil tubing string, comprising:

a support frame mounted on the vehicle;

a first telescoping boom assembly mounted on said support frame, including a first secured member and a first extending member oriented to extend in a first direction;

a second telescoping boom assembly mounted on said first boom assembly and secured to said first extending member for movement therewith, said second telescoping boom assembly having a lifting upper end and a lower end from which a second extending member is adapted to extend in a direction parallel to but opposite from said first direction;

first pulley means having means for receiving a lifting cable and for allowing a lifting cable to ride thereon and movably depend from said lifting upper end;

a lifting cable extending from the extended free end of said second extending member to said first pulley means and depending therefrom to an oil tubing connector;

second pulley means mounted on said second extending member and having means for receiving a lifting cable and for allowing said lifting cable to ride thereon and for changing the direction of travel of said lifting cable at the extended free end of said second extending member, said lifting cable extending from a secured portion of said second telescoping boom assembly around said second pulley means and to said first pulley means, whereby said first extending member can be extended to position said lifting cable over the tubing and said second extending member can be extended to raise said lifting cable and connected tubing and the position of said second pulley means relative to said first pulley means is independent of the extension of said first telescoping boom assembly.

13. A vehicle as defined in claim 12, further comprising a working cable supply drum with a working cable thereon rotatably mounted on said support frame;

a working pulley means having a means for receiving a working cable and for allowing said working cable to extend from said supply drum and to ride thereon and movably depend from said lifting end, said working pulley means and said first pulley means being mounted coaxially on said second telescoping boom assembly lifting upper end.

14. A vehicle as defined in claim 13, further comprising clamping means for clamping onto and securing the hoisted object to said lifting upper end other than by said lifting cable and for allowing said lifting cable to be disconnected from the hoisted object, said clamping means depending from said lifting upper end and positioned beneath said first pulley means.

15. A vehicle as defined in claim 12, further comprising support legs secured to said lifting upper end and positionable to contact the ground surface.

16. A vehicle as defined in claim 15, further comprising clamping means for clamping onto and securing the hoisted object to said lifting end other than by said lifting cable and allowing said lifting cable to be disconnected from the hoisted object.

17. A vehicle as defined in claim 12, further comprising a working cable supply drum with a working cable thereon rotatably mounted on said support frame;

working pulley means having means for receiving said working cable and for allowing said working cable to extend from said supply drum and to ride thereon and movably depend from said lifting end, said working pulley means and said first pulley means being mounted coaxially on said second telescoping boom assembly lifting upper end.

18. A vehicle as defined in claim 12, further comprising clamping means for clamping onto and securing the hoisted object to said lifting upper end other than by said lifting cable in order to allow said lifting cable to be disconnected from the hoisted object, said clamping means depending from said lifting upper end and positioned beneath said first pulley means.

19. A vehicle as defined in claim 18, wherein said clamping means includes a bowl element secured to said lifting upper end and a set of clamping inserts, said bowl element having an aperture extending vertically therethrough, at least the upper portion of said aperture being generally frusto-conical in configuration so as to have angled sides, said clamping inserts each having an overall arcuate configuration with a generally downwardly tapered thickness corresponding to said angled sides, whereby the lifted object may pass through said aperture and said inserts slid down into said aperture until said angled sides cause said tapered inserts to converge and securely clamp onto the lifted object.

20. A method of raising oil well tubing a predetermined distance comprising:

removing apparatus blocking the oil well tubing in the oil well casing to provide access to the upper end of the tubing;

providing a hoisting apparatus comprising:

a first telescoping boom assembly including a first extending member oriented to extend in a first direction;

a second telescoping boom assembly mounted on the first boom assembly and secured to the first extending member, the second telescoping boom assembly having a lifting upper end and a lower end from which a second extending member adapted to extend in a direction parallel to but opposite from the first direction;

a pair of support legs adapted for connection to the lifting upper end;

first pulley means for allowing a lifting cable to ride thereon and movably depend from the lifting upper end;

a lifting cable extending from the extended free end of the second extending member over the first pulley means and depending therefrom;

telescoping outward the first extending member until the lifting cable depending portion is positioned above the tubing;

bracing the second telescoping boom assembly with the support legs so that the legs extend from the lifting upper end to the ground;

securing the lifting cable to the tubing; and extending the second extending member to raise the lifting cable depending portion and the tubing.

21. The method of claim 20, further comprising, providing a clamping means that depends from the lifting upper end and is positioned beneath the first pulley means for clamping onto and securing the hoisted object in a raised position independent of the lifting cable, raising the lifting cable through the clamping means and clamping the tubing in the clamping means to support the tubing independent of the lifting cable.

22. The method of claim 21, wherein said clamping step includes providing a slip holding device comprising a bowl element and a set of clamping inserts, the bowl element having an aperture extending vertically therethrough, at least the upper portion of the aperture being generally frusto-conical in configuration so as to have angled sides;

raising the tubing through the aperture; and sliding the inserts down into the aperture until the angled sides cause the tapered inserts to converge and securely clamp onto the tubing.

23. The method of claim 22, further comprising providing a supply drum of working cable;

feeding the working cable from the supply drum over the first pulley means and down into the oil well casing.

* * * * *